US012669296B2

(12) United States Patent
Wang et al.

(10) Patent No.: US 12,669,296 B2
(45) Date of Patent: Jun. 30, 2026

(54) HEAT EXCHANGER

(71) Applicant: ZHEJIANG DUNAN ARTIFICIAL ENVIRONMENT CO., LTD., Shaoxing (CN)

(72) Inventors: Guanjun Wang, Shaoxing (CN); Wenjian Wei, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 74 days.

(21) Appl. No.: 18/602,063

(22) Filed: Mar. 12, 2024

(65) Prior Publication Data

US 2024/0210122 A1 Jun. 27, 2024

Related U.S. Application Data

(63) Continuation of application No. PCT/CN2022/117993, filed on Sep. 9, 2022.

(30) Foreign Application Priority Data

Sep. 13, 2021 (CN) ..... 202122214879.8
Sep. 28, 2021 (CN) ..... 202122371894.3

(51) Int. Cl.
*F28F 1/02* (2006.01)
*F28F 1/32* (2006.01)

(52) U.S. Cl.
CPC ..... *F28F 1/022* (2013.01); *F28F 1/32* (2013.01)

(58) Field of Classification Search
CPC ..... F28D 1/047; F28D 1/0476; F28D 1/0471; F28D 1/0475; F28D 1/053; F25B 39/00;
(Continued)

(56) References Cited

U.S. PATENT DOCUMENTS

2017/0276433 A1* 9/2017 Avila et al. ..... F28D 1/0246
2023/0314085 A1* 10/2023 Wang ..... F28D 7/163 165/175

FOREIGN PATENT DOCUMENTS

CN 1107221 A 8/1995
CN 105202816 A 12/2015
(Continued)

OTHER PUBLICATIONS

First Notice of Reasons for Rejection of JP2024-502470.
International Search Report of PCT/CN2022/117993.
First Notice of Reasons for Refusal of KR10-2024-7005876.

*Primary Examiner* — Paul Alvare
*Assistant Examiner* — Kamran Tavakoldavani

(57) ABSTRACT

A heat exchanger and a microchannel heat exchanger are provided. The heat exchanger includes a plurality of heat exchange pipes arranged in sequence along a preset direction, each of the plurality of heat exchange pipes is a flat pipe and includes a first pipe segment and a second pipe segment which are connected with each other; the first pipe segments is provided with a preset bending line, and the preset bending line is perpendicular to the preset direction; an included angle is defined between a plane where a flat side of the first pipe segment is located and a plane where a corresponding flat side of the second pipe segment is located, after the plurality of first pipe segments being bent along the preset bending line, the first pipe segments of adjacent two of the heat exchange pipes are capable of being in contact with each other.

19 Claims, 7 Drawing Sheets

(58) Field of Classification Search
CPC ..... F28F 1/022; F28F 1/02; F28F 1/32; F28F 2260/02; F28F 1/025
See application file for complete search history.

(56) References Cited

FOREIGN PATENT DOCUMENTS

| | | | |
|---|---|---|---|
| CN | 105518405 | A | 4/2016 |
| CN | 210321335 | U | 4/2020 |
| CN | 213120167 | U | 5/2021 |
| CN | 215984072 | U | 3/2022 |
| CN | 216159683 | U | 4/2022 |
| JP | 08145580 | A | 6/1996 |
| JP | H08145580 | A | 6/1996 |
| JP | 2008170041 | A | 7/2008 |
| KR | 100335872 | B1 | 9/2002 |

* cited by examiner

HEAT EXCHANGER

CROSS-REFERENCE TO RELATED APPLICATIONS

This application is a continuation of international patent application No. PCT/C N2022/117993, filed on Sep. 9, 2022, which itself claims priority to Chinese patent application Nos. 202122214879.8, filed on Sep. 13, 2021, and titled "HEAT EXCHANGER"; 202122371894.3, filed on Sep. 28, 2021, and titled "MICROCHANNEL HEAT EXCHANGER". The contents of the above identified applications are hereby incorporated herein in their entireties by reference.

TECHNICAL FIELD

The present disclosure relates to the field of heat exchanger technology, and in particular, to a heat exchanger.

BACKGROUND

In the related art, a plurality of heat exchange pipes of a heat exchanger are usually bent to obtain a greater heat exchange area in a limited space.

However, among the heat exchange pipes after bent, two adjacent heat exchange pipes are usually arranged at intervals, which is not conducive to a heat exchange of the heat exchanger.

SUMMARY

According to various embodiments of the present disclosure, a heat exchanger and a microchannel heat exchanger are provided.

The present disclosure provides a heat exchanger, the heat exchanger includes a plurality of heat exchange pipes arranged in sequence along a preset direction, each of the plurality of heat exchange pipes is a flat pipe and includes a first pipe segment and a second pipe segment which are connected with each other. The first pipe segment is provided with a preset bending line, and the preset bending line is perpendicular to the preset direction. An included angle is defined between a plane where a flat side of the first pipe segment is located and a plane where a corresponding flat side of the second pipe segment is located, and after the first pipe segment being bent along the preset bending line, adjacent two first pipe segments corresponding to any adjacent two of the plurality of heat exchange pipes are capable of being in contact with each other.

In some embodiments, before the first pipe segment being bent, the included angle between the plane where the flat side of the first pipe segment is located and the plane where the corresponding flat side of the second pipe segment is located is greater than or equal to 55° and less than 85°.

In some embodiments, before the first pipe segment being bent, flat sides of first pipe segments of the plurality of heat exchange pipes are parallel to each other.

In some embodiments, each of the plurality of heat exchange pipes further includes two second pipe segments, and the two second pipe segments are respectively connected with two ends of the first pipe segment.

In some embodiments, the two second pipe segments are denoted as a third pipe segment and a fourth pipe segment, flat sides of the third pipe segments of the plurality of heat exchange pipes are parallel to each other; flat sides of the fourth pipe segments of the plurality of heat exchange pipes are parallel to each other; after the first pipe segment being bent, a plane where an axis of the third pipe segment is located and a plane where an axis of the fourth pipe segment is located are parallel to each other or an included angle is defined between the plane where the axis of the third pipe segment is located and the plane where the axis of the fourth pipe segment is located.

In some embodiments, each of the plurality of heat exchange pipes further includes two torsional pipe segments between the first pipe segment and the third pipe segment and between the first pipe segment and the fourth pipe segment respectively, to correspondingly connect the first pipe segment and the third pipe segment and connect the first pipe segment and the fourth pipe segment.

In some embodiments, before the first pipe segment being bent, in each of the plurality of heat exchange pipes, along an extension direction of the first pipe segment, a sum of a length of the first pipe segment and length of the two torsional pipe segments is denoted as S; and a width of a flat surface of each of the plurality of heat exchange pipes is denoted as W, and the width W of the flat surface of each of the plurality of heat exchange pipes and the sum S of the length of the first pipe segment and the length of the two torsional pipe segments satisfies the following relationship: $3W \leq S \leq 8W$.

In some embodiments, a fin structure is disposed on the second pipe segment in one of adjacent two of the plurality of heat exchange pipes.

In some embodiments, the heat exchanger further includes a fluid collecting pipe, the fluid collecting pipe extends in a preset direction, and a plurality of second pipe segments are connected and in communication with the fluid collecting pipe.

In some embodiments, the plurality of heat exchange pipes are an integrated structure by a molding process.

In some embodiments, the heat exchanger is used as a microchannel heat exchanger, the heat exchanger includes two second pipe segments, and the first pipe segment is located between the two second pipe segments; two torsional pipe segments are respectively disposed between the first pipe segment and the two second pipe segments to connect the first pipe segment and the two second pipe segments, and each of the two torsional pipe segments includes two torsional portions and a bending portion, one of the two torsional portions is connected to one of the two second pipe segments, the other of the two torsional portions is connected to the first pipe segment, and each of the two torsional portions is formed by twisting with a preset angle relative to a corresponding second pipe segment; the bending portion is located between the two torsional portions and formed by bending with a preset bending radius; along a preset direction, the plurality of the heat exchange pipes are inserted in front and back at the first pipe segment, and the bending portion of each of the two torsional pipe segments includes a front arc part with a radius denoted as R and a rear arc part with a radius denoted as r, wherein, the radius R of the front arc part and the radius r of the rear arc part satisfy the following relationship: $R>r$, and $5.5t \leq r \leq 25t$, wherein t is pipe thickness of the two second pipe segments of the heat exchange pipe.

In some embodiments, the radius R of the front arc part and the radius r of the rear arc part satisfy the following relationship: $1<R/r<1.2$.

In some embodiments, an included angle between the two second pipe segments of the heat exchange pipe is denoted as θ, a length of each of the two torsional portions is denoted as $L_2$, when the included angle θ satisfies the following relationship: $23\theta \le \theta \le 70°$, and the length $L_2$ of each of the two torsional portions satisfies the following relationship: $1.05T \le L_2 \le 1.25T$, where T is a width of the heat exchange pipe.

In some embodiments, a length of the first pipe segment before processing is denoted as L, the length L of the first pipe segment before processing, the included angle θ, the pipe thickness t of the two second pipe segments, and the width T of the heat exchange pipe satisfy the following relationship: $(6\ t\pi(180-\theta)+2.2T) \le L \le (25.5\ t\pi(180-\theta)+2.5T)$.

In some embodiments, an included angle between the two second pipe segments of the heat exchange pipe is denoted as θ, a length of each of the two torsional portions is denoted as $L_2$, when the included angle θ satisfies the following relationship: $0° \le \theta \le 5°$, and the length $L_2$ of each of the two torsional portions satisfies the following relationship: $1.5T \le L_2 \le 3.5T$, where T is a width of the heat exchange pipe.

In some embodiments, a length of the first pipe segment before processing is denoted as L, the length L of the first pipe segment before processing, the width T of the heat exchange pipe, the pipe thickness t of the two second pipe segments and the included angle θ satisfy the following relationship: $6\ t\pi(180-\theta)+3.1T \le L \le 25.5\ t\pi(180-\theta)+7T$.

In some embodiments, an angle of the two torsional portions twisting relative to the corresponding second pipe segment is denoted as β, the angle β of the two torsional portions twisting relative to the corresponding second pipe segment satisfies the following relationship: $50° \le \beta \le 90°$.

In some embodiments, a pipe thickness of the bending portion is denoted as $t_1$, and the pipe thickness $t_1$ of the bending portion and the pipe thicknesses t of the two second pipe segments satisfies the following relationship: $0.95t \le t_1 \le t$.

In some embodiments, adjacent two of the plurality of heat exchange pipes, which are in front-to-back contact, abut respectively inside and outside the first pipe segment.

In some embodiments, the heat exchanger further includes a fin structure, and the fin structure is sandwiched between the second pipe segments of adjacent two of the plurality of heat exchange pipes.

The present disclosure further provides a microchannel heat exchanger, the microchannel heat exchanger includes a plurality of heat exchange pipes arranged in a preset direction, wherein each of the plurality of heat exchange pipes includes two second pipe segments and a first pipe segment between the two second pipe segments; the first pipe segment includes two torsional portions and a bending portion, the two torsional portions are respectively connected to the two second pipe segments, and each of the two torsional portions is formed by twisting with a preset angle relative to a corresponding second pipe segment; the bending portion is located between the two torsional portions and is formed by bending with a preset bending radius; and along a preset direction, the plurality of heat exchange pipes are inserted in front and back at the first pipe segment, and a front arc portion with a radius denoted as R and a rear arc portion with a radius denoted as r are formed at the bending portion of each of the two torsional pipe segments, wherein, the radius R and the radius r satisfy the following relationship: $R>r$ and $5.5t \le r \le 25t$, wherein t is pipe thickness of the two second pipe segments of the heat exchange pipe.

In some embodiments, the radius R of the front arc part and the radius r of the rear arc part satisfy the following relationship: $1<R/r<1.2$.

In some embodiments, an included angle between the two second pipe segments of the heat exchange pipe is denoted as θ, a length of each of the two torsional portions is denoted as $L_2$, when the included angle θ satisfies the following relationship: $23° \le \theta \le 70°$, and the length $L_2$ of each of the two torsional portions satisfies the following relationship: $1.05T \le L_2 \le 1.25T$, where T is a width of the heat exchange pipe.

In some embodiments, a length of the first pipe segment before processing is denoted as L, the length L of the first pipe segment before processing, the included angle θ, the pipe thickness t of the two second pipe segments, and the width T of the heat exchange pipe satisfy the following relationship: $(6t\pi(180-\theta)+2.2T) \le L \le (25.5\ t\pi(180-\theta)+2.5T)$.

In some embodiments, an included angle between the two second pipe segments of the heat exchange pipe is denoted as θ, a length of each of the two torsional portions is denoted as $L_2$, when the included angle θ satisfies the following relationship: $0° \le \theta \le 5°$ and the length $L_2$ of each of the two torsional portions satisfies the following relationship: $1.5T \le L_2 \le 3.5T$, where T is a width of the heat exchange pipe.

In some embodiments, a length of the first pipe segment before processing is denoted as L, the length L of the first pipe segment before processing, the width T of the heat exchange pipe, the pipe thickness t of the two second pipe segments and the included angle θ satisfy the following relationship: $6t\pi(180-\theta)+3.1T \le L \le 25.5\ t\pi(180-\theta)+7T$.

In some embodiments, an angle of the two torsional portions twisting relative to the corresponding second pipe segment is denoted as β, the angle β of the two torsional portions twisting relative to the corresponding second pipe segment satisfies the following relationship: $50° \le \beta \le 90°$.

In some embodiments, a pipe thickness of the bending portion is denoted as $t_1$, and the pipe thickness $t_1$ of the bending portion and the pipe thicknesses t of the two second pipe segments satisfies the following relationship: $0.95t \le t_1 \le t$.

In some embodiments, adjacent two of the plurality of heat exchange pipes, which are in front-to-back contact, abut respectively inside and outside the first pipe segment.

In some embodiments, the heat exchanger further includes a fin structure, and the fin structure is sandwiched between the second pipe segments of adjacent two of the plurality of heat exchange pipes.

Details of one or more embodiments of this application are presented in the attached drawings and descriptions below. And other features, purposes and advantages of this application will become apparent from the description, drawings and claims.

BRIEF DESCRIPTION OF THE DRAWINGS

For a better description and illustration of embodiments and/or examples of those disclosures disclosed herein, reference may be made to one or more attached drawings. Additional details or examples used to describe the drawings should not be considered as limiting the scope of any of the disclosed disclosures, currently described embodiments and/or examples, and currently understood best modes of these disclosures.

Figure 1:
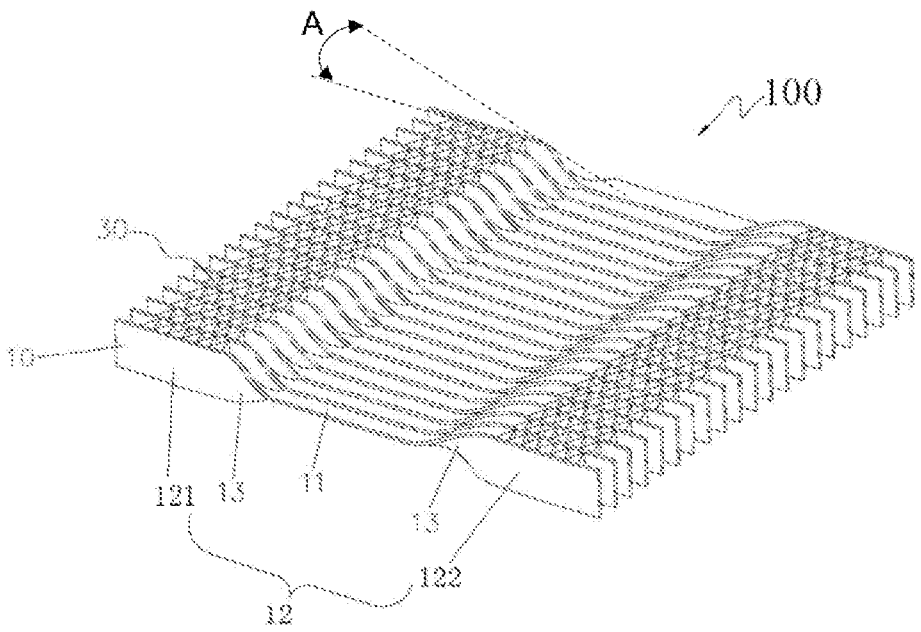
FIG. 1 is a schematic view of a plurality of heat exchange pipes of a heat exchanger before bending according to one or more embodiments.

Wherein, reference signs are as follows:

100 represents a heat exchanger or a microchannel heat exchanger; 10 represents a heat exchange pipe; 11 represents a first pipe segment; 11A represents a preset bending line; 12 represents a second pipe segment; 121 represents a third pipe segment; 122 represents a fourth pipe segment; 13 represents a torsional pipe segment; 111 represents a torsion portion; 112 represents a bending portion; 112A represents a front arc portion; 112B represents a rear arc portion; 20 represents a fluid collecting pipe; 21 represents a first fluid collecting pipe; 22 represents a second fluid collecting pipe; and 30 represents a fin structure.

DETAILED DESCRIPTION

The technical scheme in the embodiment of this application will be described clearly and completely with the attached drawings. Obviously, the described embodiment is only a part of the embodiment of this application, not the whole embodiment. Based on the embodiments in this application, all other embodiments obtained by ordinary technicians in this field without creative work belong to the protection scope of this application.

It should be noted that when a component is considered to be "mounted" on another component, it can be directly on the other component or there can be a component in the middle. When a component is considered to be "set on" another component, it can be directly set on another component or there may be intervening components at the same time. When a component is considered to be "fixed" to another component, it can be directly fixed to another component or there may be intervening components at the same time.

Unless otherwise defined, all technical and scientific terms used herein have the same meaning as commonly understood by those skilled in the technical field of this application. The terminology used herein in the specification of this application is only for the purpose of describing specific embodiments, and is not intended to limit this application. As used herein, the term "or/and" includes any and all combinations of one or more related listed items.

Referring to FIG. 1 to FIG. 5, the present disclosure provides a heat exchanger 100. The heat exchanger 100 includes a plurality of heat exchange pipes 10 arranged in sequence along a preset direction 1, each of the plurality of heat exchange pipes 10 is a flat pipe and includes a first pipe segment 11 and a second pipe segment 12 which are connected with each other. The first pipe segment 11 is provided with a preset bending line 11A, and the preset bending line 11A is perpendicular to an axis of the first pipe segment 11. An included angle is defined between a plane where a flat side of the first pipe segment 11 is located and a plane where a corresponding flat side of the second pipe segment 12 is located. After the first pipe segments 11 being bent along the preset bending line 11A, adjacent two first pipe segments 11 corresponding to any adjacent two of the plurality of heat exchange pipes 10 are capable of being in contact with each other.

Specifically, a surface of the flat side of the first pipe segment 11 is perpendicular to a direction of a pipe thickness of the first pipe segment 11. Each of the first pipe segments 11 of the plurality of heat exchange pipes 10 is provided with a preset bending line 11A, the preset bending lines 11A of the first pipe segments 11 are perpendicular to the preset direction 1, and the preset bending lines of the first pipe segments 11 are parallel to each other.

It should be noted that when the flat pipe is a flat pipe with a rectangular surface, the flat pipe has four surfaces, and lengths of the four surfaces are all equal. Two of the four surfaces have greater width and are defined as the flat sides of the flat pipe, and the two surfaces of the four surfaces having greater width are arranged along a thickness direction of the flat pipe.

In an implementation process, each of the first pipe segments 11 is twisted by a certain angle relative to the corresponding second pipe segment 12. An included angle denoted as A is defined between a plane where a flat side of the first pipe segment 11 is located and a plane where a corresponding flat side of the second pipe segment 12 is located, so that after the first pipe segments 11 are bent along the preset bending line 11A, adjacent two first pipe segment 11 corresponding to adjacent two of the heat exchange pipes 10 is capable of being in contact with each other. This structural arrangement can enhance a heat exchange effect between adjacent two of the first pipe segments 11, thereby enhancing a heat exchange effect between adjacent two of the heat exchange pipes 10, further improving a heat exchange effect of the heat exchanger 100, and solving a problem of poor heat exchange effect of the heat exchanger in related art.

It should be noted that before twisting the first pipe segment 11, the flat side of the first pipe segment 11 of each of the heat exchange pipes 10 and the flat side of the corresponding second pipe segment 12 of each of the heat exchange pipes 10 are in a same plane. Optically, each of the heat exchange pipe 10 is an integrated structure by a molding process, which is convenient for an installation and processing of the heat exchanger 100.

It should be noted that because the preset bending line 11A of the first pipe segments 11 overlaps, the preset direction/is an extension direction of a preset straight line, that is, the plurality of heat exchange pipes 10 are successively disposed along the extension direction of the preset straight line, and an extension directions of the heat exchange pipe 10 are perpendicular to the preset direction 1.

In an embodiment, flat sides of the plurality of the second pipe segments 12 are parallel to each other.

In some embodiments, referring to FIG. 1, before the plurality of first pipe segments 11 being bent, the included angle A between the plane where the flat side of the first pipe segment 11 is located and the plane where the corresponding flat side of the second pipe segment 12 is located is greater than or equal to 55° and less than 85°. In this way, it is ensured that adjacent two first pipe segments 11 can be in contact with each other after the plurality of the first pipe segments 11 are bent. That is, a twist angle of each of the first pipe segments 11 relative to the corresponding second pipe segment 12 is greater than or equal to 55° and less than 85°.

In some embodiments, before the first pipe segments 11 being bent, the flat sides of the first pipe segments 11 are parallel to each other, that is, the included angles between the planes where the flat sides of the first pipe segments 11 are located and the planes where the flat sides of the corresponding second pipe segments 12 are located are the same, and the twisting angles of the plurality of the first pipe segments 11 are equal to each other.

It should be noted that the corresponding second pipe segment 12 of the first pipe segment 11 means that the first pipe segment 11 and the second pipe segment 12 belong to the same heat exchange pipe 10.

In some embodiments, each of the heat exchange pipes 10 includes two second pipe segments 12, and the two second pipe segments 12 are respectively connected to two ends of the first pipe segment 11. The two second pipe segments 12 of each of the heat exchange pipe 10 are denoted as a third pipe segment 121 and a fourth pipe segment 122, respectively.

In some embodiments, before or after the first pipe segment 11 being bent, flat sides of a plurality of the third pipe segments 121 are parallel to each other, and flat sides of a plurality of the fourth pipe segments 122 are parallel to each other. The third pipe segments 121 are all located at one end of the first pipe segments 11, and the fourth pipe segments 122 are all located at the other end of the first pipe segments 11.

Figure 2:
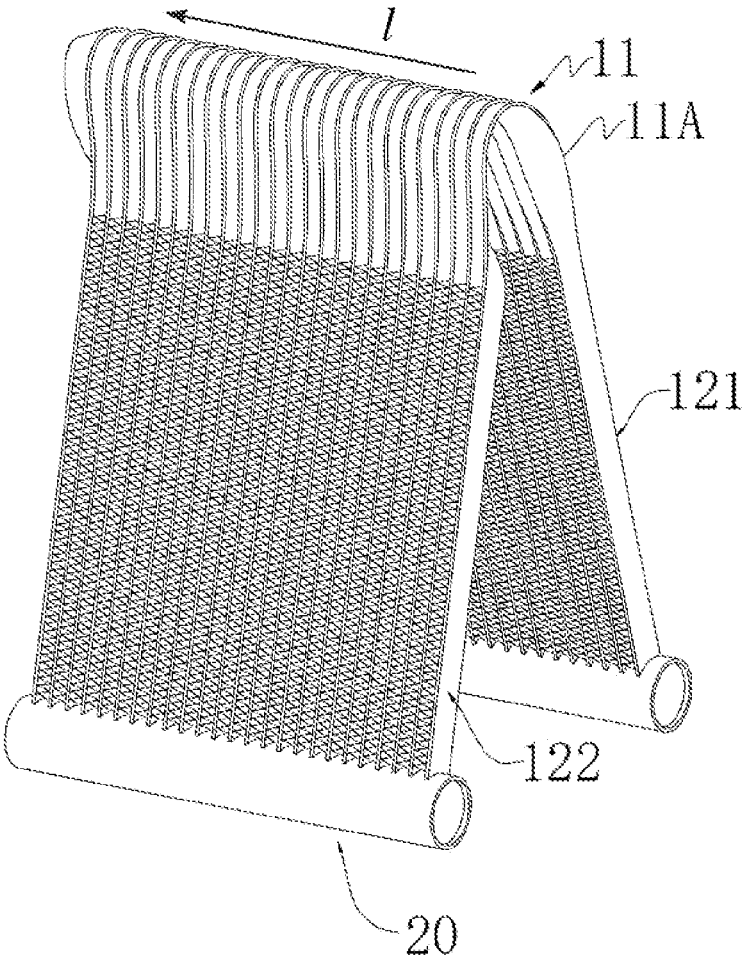
FIG. 2 is a structural schematic view of a plurality of heat exchange pipes of a heat exchanger after bending in FIG. 1.
Figure 3:
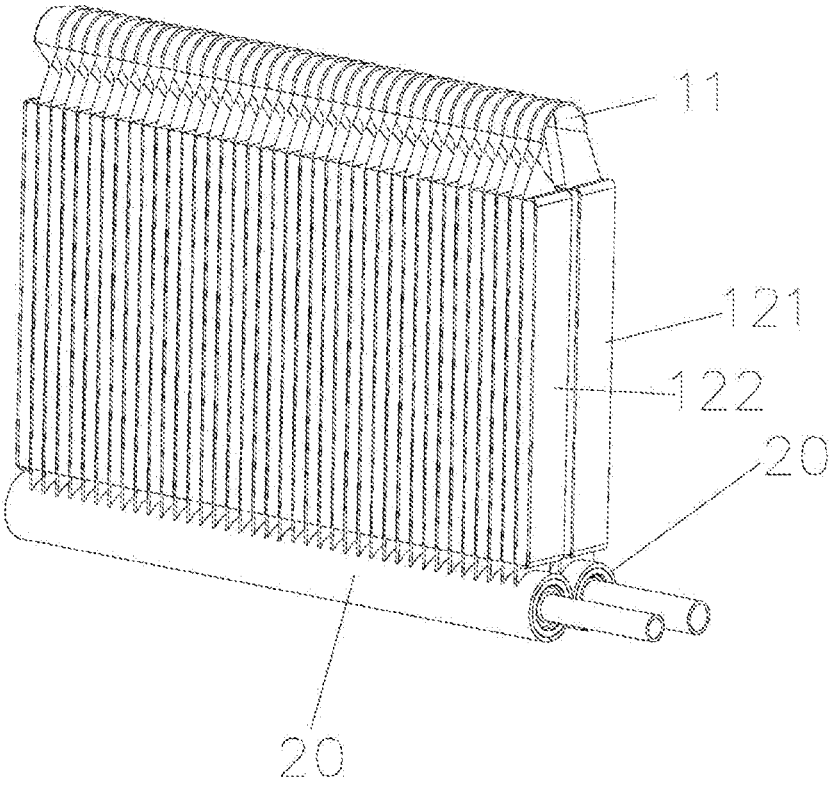
FIG. 3 is another structural schematic view of a plurality of heat exchange pipes of a heat exchanger after bending in FIG. 1.
Figure 4:
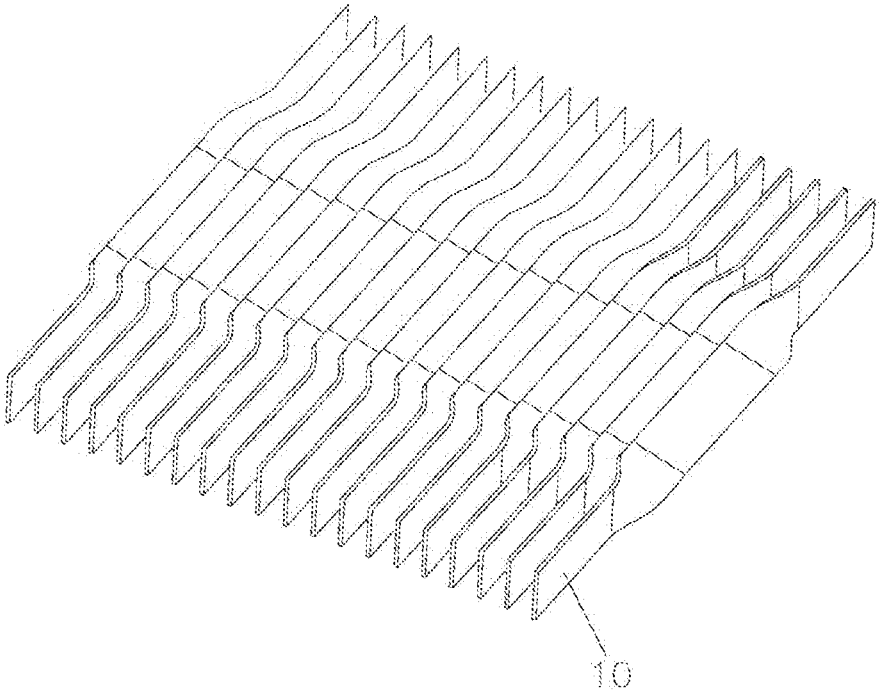
FIG. 4 is a schematic view of a heat exchanger without a fin structure in FIG. 1.

Specifically, before the first pipe segment 11 being bent, the axis of each of the third pipe segments 121 coincides with the axis of each of the fourth pipe segments 122. Referring to FIG. 2 and FIG. 3, when the plurality of first pipe segments 11 are bent, the axis of each of the third pipe segments 121 and the axis of each of the fourth pipe segments 122 are parallel to each other, or an included angle is defined between the axis of each of the third pipe segments 121 and the axis of each of the fourth pipe segments 122.

In some embodiments, a torsional pipe segment 13 is arranged between the first pipe segment 11 and the second pipe segment 12 of each of the heat exchange pipe 10 to connect the first pipe segment 11 and the second pipe segment 12. In some embodiments, before the plurality of first pipe segments 11 are bent, for each of the heat exchange pipes 10, the torsional pipe segment 13 of the heat exchange pipe 10 is twisted, so that an included angle between the plane where the flat side of the first pipe segment 11 of the heat exchange pipe 10 is located and the plane where the flat side of the second pipe segment 12 is located is formed.

In some embodiments, each of the heat exchange pipes 10 includes two torsional pipe segments 13, wherein one of the two torsional pipe segments 13 is arranged between the first pipe segment 11 and the third pipe segment 121 to connect the first pipe segment 11 and the third pipe segment 121, the other of the two torsional pipe segments 13 is arranged between the first pipe segment 11 and the fourth pipe segment 122 to connect the first pipe segment 11 and the fourth pipe segment 122. The two torsional pipe segments 13 are respectively configured to connect the first pipe segment 11 with the third pipe segment 121 and connect the first pipe segment 11 with the fourth pipe segment 122 in a transitional way, thus effectively preventing the heat exchange pipe 10 from being broken due to excessive torsion.

Figure 5:
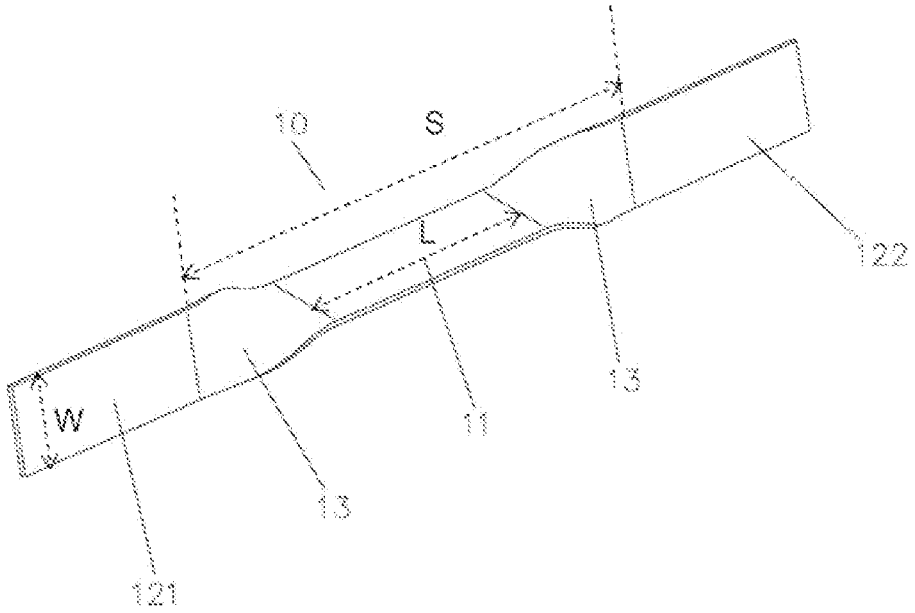
FIG. 5 is a schematic view of a heat exchange pipe of a heat exchanger before bending in FIG. 1.

In some embodiments, referring to FIG. 5, before the plurality of first pipe segments 11 being bent, in each of the heat exchange pipes 10, along an extending direction of the first pipe segments 11, a sum of a length of the first pipe segment 11 and a length of the two torsional pipe segments 13 is denoted as S, that is, a distance between the two second pipe segments 12 is S, a width of a flat surface of the heat exchange pipe 10 is denoted as W, and the width W of the flat surface of the heat exchange pipe 10 and the sum S of the length of the first pipe segment 11 and the length of the two torsional pipe segments 13 satisfy the following relationship: $3W \leq S \leq 8W$. In some embodiment, the fin structure 30 is disposed on the second pipe segment 12, and not disposed on the first pipe segment 11 and the torsional pipe segment 13, that is, the first pipe segment 11 and the torsional pipe segment 13 are both without the fin structure (i.e. the first pipe segment 11 and the torsional pipe segment 13 are regarded as a wingless segment) and the second pipe segment 12 is equipped with the fin structure 30, to avoid the phenomena that if the wingless segment is too long, an effective heat exchange area of the heat exchanger 100 will be reduced.

It should be noted that the length of the torsional pipe segment 13 refers to a distance between two ends of the torsional pipe segment 13 in an extending direction of the first pipe segment 11.

It should be noted that the extension direction of each of the first pipe segments 11 is same as that of the corresponding second pipe segment 12 before and after the first pipe segment 11 is twisted relative to the second pipe segment 12.

In some embodiments, the fin structure 30 is arranged on each of the plurality of heat exchange pipes 10. When each of the plurality of heat exchange pipes 10 includes one second pipe segment 12, the fin structure 30 is arranged on the second pipe segment 12. When each of the plurality of heat exchange pipes 10 includes two second pipe segments 12, the fin structure 30 is arranged on one of the two second pipe segments 12.

Specifically, the fin structure 30 is disposed on the flat side of the corresponding second pipe segment 12.

In some embodiments, the heat exchanger 100 further includes a fluid collecting pipe 20, which extends along the preset direction 1, and the plurality of the second pipe segments 12 are connected and in communication with the fluid collecting pipe 20.

In some embodiments, the number of the fluid collecting pipes 20 is two, the plurality of third pipe segments 121 are connected and in communication with one of the two fluid collecting pipes 20, and the plurality of fourth pipe segment 122 are connected and in communication with the other of the two fluid collecting pipes 20. Specifically, the two fluid collecting pipes 20 can be defined as a first fluid collecting pipe 21 and a second fluid collecting pipe 22. Ends of the two second pipe segments 12 (i.e. the third pipe segments 121 and the fourth pipe segment 122) of the heat exchange pipe 10 are inserted and connected to the first fluid collecting pipe 21 and the second fluid collecting pipe 22.

From the above description, it can be seen that the above embodiments of the present disclosure have the following technical effects.

In the heat exchanger 100 of the present disclosure, the heat exchanger 100 includes the plurality of heat exchange pipes 10 arranged in sequence along the preset direction 1, each of the plurality of heat exchange pipes 10 is the flat pipe and includes the first pipe segment 11 and the second pipe segment 12 which are connected with each other; the plurality of first pipe segments 11 are provided with the preset bending line 11A, and the preset bending line 11A is perpendicular to the axis of the first pipe segments 11. The included angle is formed between the plane where the flat side of the first pipe segment 11 is located and the plane where the corresponding flat side of the second pipe segment 12 is located are disposed, so that after the plurality of first pipe segments 11 being bent along the preset bending line 11A, the first pipe segments 11 of adjacent two heat exchange pipes 10 are in contacted with each other.

In some embodiments, each of the first pipe segments 11 is twisted by the certain angle relative to the corresponding second pipe segment 12. Such that the included angle is formed between the plane where the flat side of each of the first pipe segments 11 is located and the plane where the flat side of the corresponding second pipe segment 12 is located, so that after the plurality of first pipe segments 11 are bent along the preset bending line 11A, the first pipe segments 11 of adjacent two heat exchange pipes 10 can be in contact with each other, and it can enhance a heat exchange effect between adjacent two first pipe segments 11, thereby enhancing the heat exchange effect between adjacent two heat exchange pipes 10, further improving a heat exchange effect of the heat exchanger 100, and solving the problem of poor heat exchange effect of the heat exchanger 100 in related technology.

In some embodiments, the heat exchange pipe 10 includes two second pipe segments 12 and the first pipe segment 11 between the two second pipe segments 12. In the preset direction 1, that is, the direction indicated by the arrow in FIG. 6, the plurality of heat exchange pipes 10 are inserted back and forth at the first pipe segment 11. It can be understood that a rear portion of the first pipe segment 11 of the heat exchange pipe 10 at a front side is inserted into the first pipe segment 11 of the heat exchange pipe 10 at the adjacent rear side along a direction indicated by an arrow in FIG. 6.

A torsional pipe segment 13 is arranged between the first pipe segment 11 and the second pipe segment 12 to connect the first pipe segment 11 and the second pipe segment 12. The torsional pipe segment 13 includes two torsional portions 111 which are respectively connected with two second pipe segments 12 and twisted by a preset angle relative to the corresponding second pipe segment 12, and the bending portion 112 between two torsional portions 111 and bent with a preset bending radius.

Figure 8:
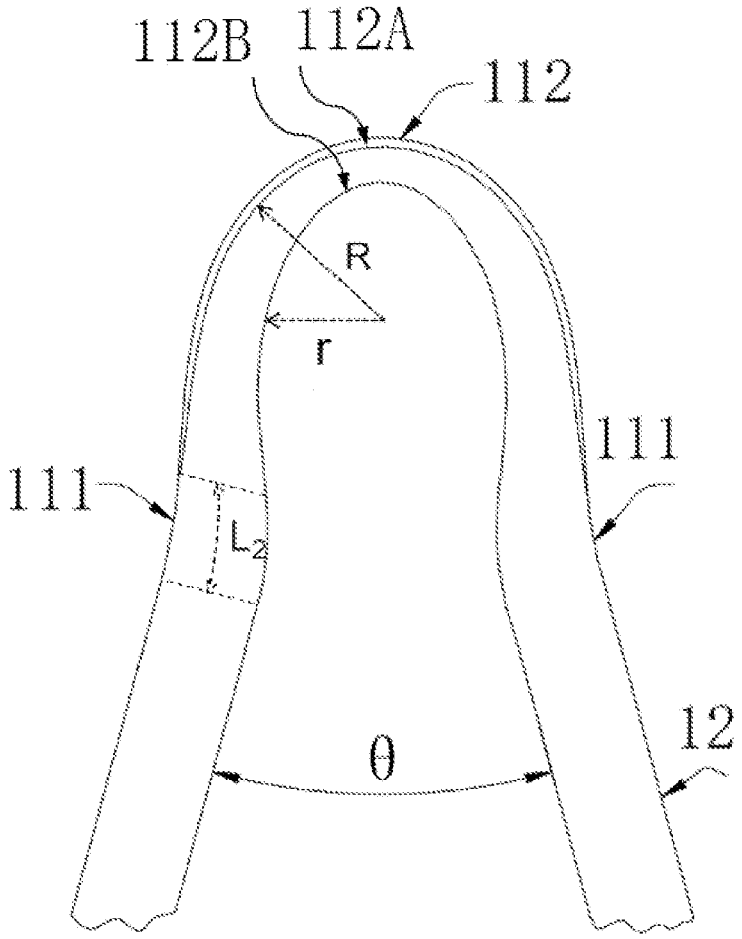
FIG. 8 is a schematic view of a heat exchange pipe from another perspective in FIG. 7.

Referring to FIG. 8, at the bending portion 112 of each of the first pipe segment 11, a front arc portion 112A with a radius of R and a rear arc portion 112B with a radius of r are formed. In a process of assembling the heat exchanger 100, along the direction/indicated by the arrow in FIG. 6, a rear arc portion 112B of a front side of one first pipe segment 11 is inserted into a front arc portion 112A of a back side of another first pipe segment 11. Optically, two adjacent heat exchange pipes 10 connected in front and back can also abut inside and outside at the first pipe segment 11 (that is, a plugging position) to further improve a local strength of the heat exchanger 100 and prevent a leakage at the bending portion 112. R and r refer to a radius inside the bending part 112 of the heat exchange pipe 10 in FIG. 8.

The radius R of the front arc portion 112A is greater than the radius r of the rear arc portion 112B, that is, R>r. This is because there are both torsion and bending deformations at the first pipe segment 11 of the heat exchange pipe, which leads to torsion deformation in a part of the heat exchange pipe 10 when bending with a preset bending radius. Under superposition of the two deformations, along a pipe width direction of the heat exchange pipe 10, one edge at the bending portion 112 is deformed to be slightly greater than the preset bending radius, while the other edge at the bending portion 112 is deformed to be slightly smaller than the preset bending radius.

Figure 7:
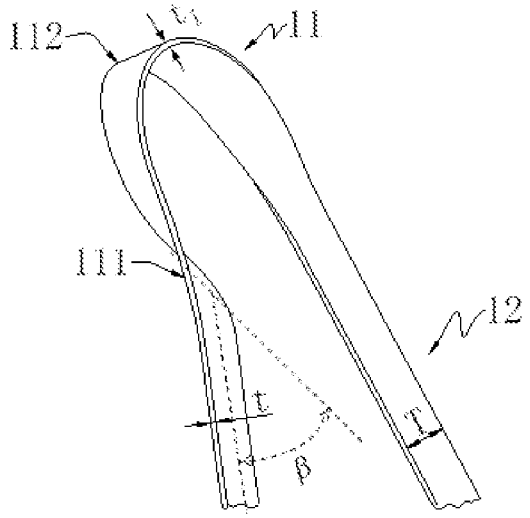
FIG. 7 is a partial schematic view of a heat exchange pipe of a heat exchanger in FIG. 6.

Referring to FIG. 7, in the following description, a pipe thickness at the second pipe segment 12, that is, a pipe thickness of the heat exchange pipe 10, is denoted by t. A pipe width of the heat exchange pipe 10 is denoted by T Referring to FIG. 7 and FIG. 8, at the bending portion 112, the relationship between the radius r of the rear arc portion 112B and the pipe thickness t is as follows: $5.5t \le r \le 25t$.

As mentioned above, when bending, the radius r of the rear arc portion 112B is reduced compared with the preset bending radius, and with the reduction of the radius r, the heat exchange pipe 10 may be excessively deformed at this local position. An excessive deformation will cause a micro-channel adjacent to the rear arc portion 112B in the heat exchange pipe 10 to be crushed and destroyed. Therefore, in order to avoid internal micro-channels of the heat exchange pipe 10 from being crushed and destroyed, a minimum value of r should be limited to be greater than or equal to 5.5 times the pipe thickness t.

At the same time, since the first pipe segment 11 is not equipped with the fin structure 30, the first pipe segment 11 of the heat exchange pipe 10 does not participate in heat exchange when the heat exchanger 100 is in operation, although limiting a minimum value of r is beneficial to avoiding internal micro-channels of the heat exchange pipe 10 from being crushed. However, r being too great will lead to the increase of a length of the first pipe segment 11, and correspondingly, the length of pipes in the heat exchange pipe 10 that not participate in heat exchange will increase, which is not conducive to an overall heat exchange of the heat exchanger 100. Especially, when r being too great, a bending at the bending portion 112 becomes inconspicuous, and a condensed water is easy to condense and drip at the bending portion 112, which is required to be avoided in the heat exchanger 100. Therefore, the pipe thickness t of r being limited to be not more than 25 times the pipe thickness t is beneficial to avoiding the above phenomenon.

It can be understood that the heat exchange pipe 10, different from ordinary pipes and plates, has a unique deformation effect in torsion and bending because of its special micro-channel structure, unlike a deformation characteristics of regular pipes and plates in torsion and bending. Through a lot of research and experiments, it is found that the local deformation degree of the heat exchange pipe 10 can be well controlled by controlling the relative multiple between the radius r of the rear arc part 112B and the pipe thickness t.

In some embodiments, the radius r of the rear arc part 112B and the radius R of the front arc part 112A satisfy with the relationship: $1<R/r<1.2$. As mentioned above, under the influence of bending and torsion, the radius R of the front arc portion 112A will be greater than the preset bending radius, while the radius r of the rear arc portion 112B will be less than the preset bending radius. If the ratio of the two changes is too large, it will make the deformation of the first pipe segment 11 too great; but if the ratio of the two changes is small, it is necessary to extend the length of the first pipe segment 11, which will obviously affect the heat exchange performance of the heat exchanger 100. Therefore, it is appropriate to choose a ratio of the radius r of the rear arc part 112B to the radius R of the front arc part 112A to be in a range of 1 and 1.2.

Figure 6:
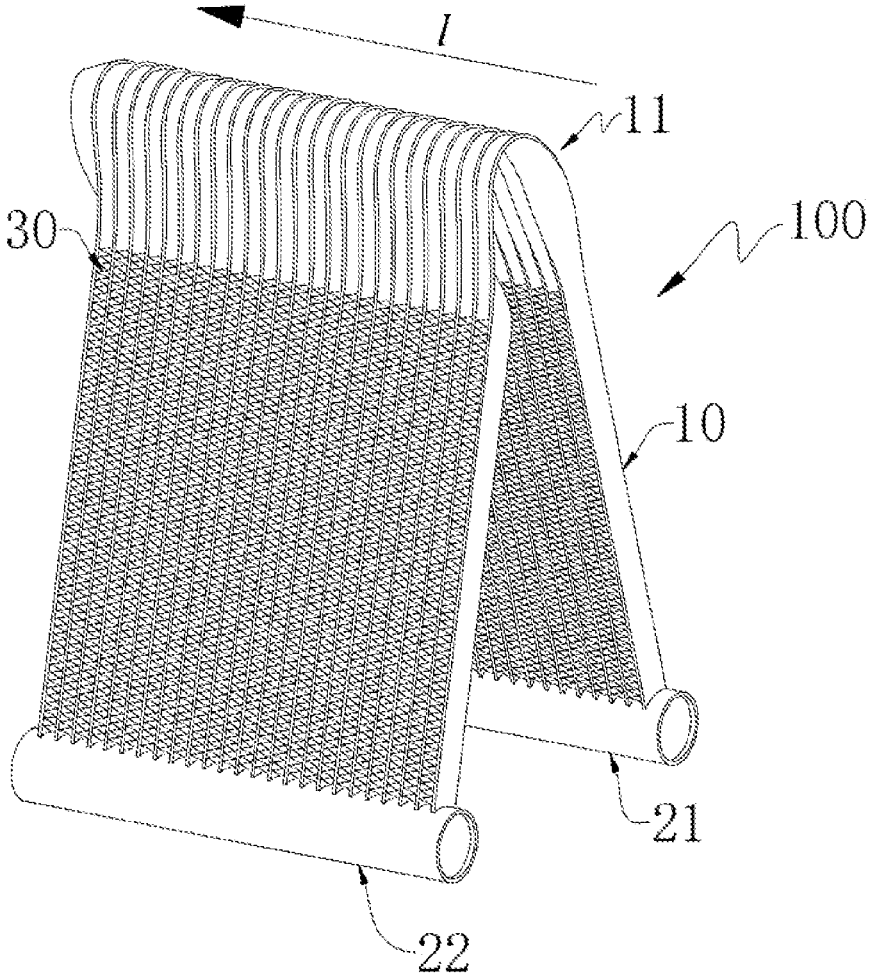
FIG. 6 is a schematic view of a heat exchanger according to one or more embodiments.

The heat exchange pipe 10 can be bent into an A-shape as shown in FIG. 6 or an N-shape, that is, double-rows bending. An included angle between the two second pipe segments 12 of the heat exchange pipe 10 is defined as θ, when the heat exchange pipe 10 is bent in A-shaped, the included angle θ between two second pipe segments 12 is an acute angle. When the heat exchange pipe 10 is bent in double rows, the included angle θ between two second pipe segments 12 is close to 0°, that is, the two second pipe segments 12 are substantially parallel to each other.

Referring to FIG. 8, a length of the torsional portion 111 is denoted as $L_2$, when the included angle θ satisfies the following relationship: $23° \leq \theta \leq 70°$, and the length $L_2$ of the torsional portion 111 satisfies the following relationship: $1.05T \leq L_2 \leq 1.25T$, where T is a width of the heat exchange pipe 10. It should be understood that "the length $L_2$ of the torsional portion 111" refers to a length of the corresponding pipe section of the heat exchange pipe 10 before torsion and bending processing, and the length of the corresponding pipe section can be measured conveniently before torsion and bending processing of the heat exchange pipe 10. As mentioned above, the first pipe segment 11 has a complex combined deformation of torsion and bending, and there is an uncertain interaction between them, which is limited to $1.05 \leq T \leq L_2 \leq 1.25$ T, so the formed inclined angle θ between two portions of the second pipe segment 12 during bending can be taken into account during torsion bending. Furthermore, it is avoided that a local deformation of the heat exchange pipe 10 substantially reaches a critical state due to twisting processing (that is, the heat exchange pipe 10 has no obvious damage), and a further deformation of the heat exchange pipe 10 during bending processing will eventually cause the pipe wall to crack or local micro-channels to be destroyed.

Furthermore, referring to FIGS. 5, 7 and 8, considering a relationship between the aforementioned r and the pipe thickness t, and an influence of other deformation factors of the heat exchange pipe 10, a length of the first pipe segment 11 before processing is denoted as L, the length L of the first pipe segment 11 before processing satisfies the following relationship: $(6t\pi(180-\theta)+2.2T) \leq L \leq (25.5\ t\pi(180-\theta)+2.5T)$. It can be understood that a length of the first pipe segment 11 of the heat exchange pipe 10 is a sum of length of two torsional portions 111 and a length of the bending portion 112. Considering a certain design error, limiting the length L of the first pipe segment 11 before processing according to the above relationship is beneficial to avoiding the damage of internal micro-channels caused by excessive local deformation of the heat exchange pipe 10, and at the same time, avoiding an influence of a wingless segment on other properties of the heat exchanger 100.

Similarly, in the embodiment where the heat exchange pipe 10 is bent in a double-row bending, when the included angle θ between two second pipe segments 12 of the heat exchange pipe 10 satisfies the following relationship: $0° \leq \theta \leq 5°$, the length $L_2$ satisfies the following relationship: $1.5T \leq L_2 \leq 3.5T$. Furthermore, in this embodiment, the length L of the first pipe segment 11 before processing satisfies the following relationship: $(6t\pi(180-\theta)+3.1T) \leq L \leq ((25.5\ t\pi(180-\theta)+7T)$.

In some embodiments, referring to FIG. 7, an angle of the torsional portion 111 relative to the second pipe segment 12 torsion is defined as β, the angle β satisfies the following relationship: $50° \leq \beta \leq 90°$, which is beneficial to ensure a processing effect of the torsional portion 111.

When the heat exchange pipe 10 is bent, the pipe thickness $t_1$ at the bending portion 112 may be reduced to some extent compared with the pipe thickness t at the second pipe segment 12. That is, when the value of r is close to 5.5t, the heat exchange pipe 10 at the bending part 112 is obviously deformed, and at this time, the situation that $t_1 \leq t$ may occur, and controlling $t_1$ within a range of $0.95t \leq t_1 \leq t$ is beneficial to avoiding excessive deformation of a local position of the heat exchange pipe 10.

In some embodiments, the heat exchanger 100 further includes a fin structure 30 sandwiched between the second pipe segments 12 of adjacent two heat exchange pipes 10, the fin structure 30 is not disposed at the first pipe segment 11, so that the first pipe segment 11 substantially does not participate in heat exchange during the operation of the heat exchanger 100.

Referring to FIG. 6 to FIG. 8, the present disclosure further provides a microchannel heat exchanger 100. Its implementation principle and technical effects are the same as the microchannel heat exchanger 100 of the above-mentioned embodiments. For the sake of brief description, please refer to the corresponding contents of the above-mentioned embodiments for what is not mentioned in this embodiment.

In this embodiment, referring to FIG. 6, the microchannel heat exchanger 100 includes a plurality of heat exchange pipes 10, a fluid collecting pipe 20 and a plurality of groups of fin structure 30 arranged in a preset direction. The fluid collecting pipe 20 includes a first fluid collecting pipe 21 and a second fluid collecting pipe 22. The ends of two second pipe segments 12 of the heat exchange pipe 10 are respectively connected to the first fluid collecting pipe 21 and the second fluid collecting pipe 22. The first fluid collecting pipe 21 and the second fluid collecting pipe 22 are arranged approximately in parallel, two ends of the heat exchange pipe 10 are respectively plugged and connected to the first fluid collecting pipe 21 and the second fluid collecting pipe 22, so that a refrigerant can be distributed from one of the first fluid collecting pipe 21 and the second fluid collecting pipe 22 into each of the heat exchange pipe 10, and flow to the other of the first fluid collecting pipe 21 and the second fluid collecting pipe 22 after heat exchange.

The heat exchange pipe 10 includes two second pipe segments 12 and a first pipe segment 11 between the two second pipe segments 12 and connected to the two second pipe segments 12. The first pipe segment 11 includes two torsional portions 111 which are respectively connected with the two second pipe segments 12 and twisted by a preset angle relative to the corresponding second pipe segment 12, and the bending portion 112 bent with a preset bending radius between the two torsional portions 111.

The following is a way to process the first pipe segment 11 on the heat exchange pipe 10:

- S100, plugging all two ends of heat exchange pipes 10 into a first fluid collecting pipe 21 and a second fluid collecting pipe 22 to form a whole;
- S200, selecting a pipe segment with a length of L at a center of the heat exchange pipe 10 to process the first pipe segment 11;
- S300, processing, in an appropriate manner, two torsional portions 111 adjacent to two second pipe segments 12 on the heat exchange pipe 10 in step S200; and
- S400, bending a part of pipe between the two torsional portions 111 to form a bending portion 112 by using an appropriate bending device.

In order to make the plurality of heat exchange pipes 10 form a relative positional relationship of front and back plugging at the first pipe segment 11, in step S100, when the heat exchange pipe 10 is plugged into the first fluid collecting pipe 21 and the second fluid collecting pipe 22, controlling a distance between adjacent two heat exchange pipes 10, the adjacent heat exchange pipes 10 are overlapped back and forth after a processing of the torsional portion 111 in step S300 is completed, and when the bending portion 112 is processed in step S400, among the heat exchange pipe 10 overlapped with each other, the back side of the heat exchange pipe 10 will be in contact with a tail of a front side of the heat exchange pipe 10, thus forming a front-back tilt and forming an approximate funnel-shaped structure at the first pipe segment 11.

Along a preset direction, the plurality of heat exchange pipes are inserted in front and back at the first pipe segment, and a front arc portion with radius R and a rear arc portion with radius r are formed at the bending portion of each of the torsional pipe segment, wherein, the radius R of the front arc portion and the radius r of the rear arc portion satisfy the following relationship: $R>r$ and $5.5t\leq r\leq 25t$, and t is pipe thicknesses at the second pipe segment of the heat exchange pipe.

In some embodiments, the radius R of the front arc portion and the radius r of the rear arc portion satisfy the following relationship: $1<R\ r<1.2$.

In some embodiments, an included angle between the two second pipe segments 12 of the heat exchange pipe is defined as θ, a length of the torsional portion 111 is defined as $L_2$, when the included angle θ satisfies the following relationship: $23°\leq\theta\leq 70°$, and the length $L_2$ satisfies the following relationship: $1.05T\leq L_2\leq 1.25T$, wherein T is a width of the heat exchange pipe 10.

In some embodiments, a length of the first pipe segment 11 before processing is denoted as L, the length L of the first pipe segment 11 before processing, the included angle θ, the pipe thickness t of the two second pipe segments, and the width T of the heat exchange pipe 10 satisfy the following relationship: $(6t\pi(180-\theta)+2.2T)\leq L\leq(25.5\ t\pi(180-\theta)+2.5T)$.

In some embodiments, an included angle between the two second pipe segments 12 of the heat exchange pipe 10 is denoted as θ, a length of each of the two torsional portions is denoted as $L_2$, when the included angle θ satisfies the following relationship: $0°\leq\theta\leq 5°$, and the length $L_2$ of each of the two torsional portions satisfies the following relationship: $1.5T\leq L_2\leq 3.5T$, where T is a width of the heat exchange pipe 10.

In some embodiments, a length of the first pipe segment 11 before processing is denoted as L, the length L of the first pipe segment 11 before processing, the width T of the heat exchange pipe, the pipe thickness t of the two second pipe segments and the included angle θ satisfy the following relationship: $(6t\pi(180-\theta)+3.1T)\leq L\leq(25.5\ t\pi(180-\theta)+7T)$.

In some embodiments, an angle of the two torsional portions 111 twisting relative to the corresponding second pipe segment 12 is denoted as β, the angle β of the two torsional portions twisting 111 relative to the corresponding second pipe segment 12 satisfies the following relationship: $500\leq\beta\leq 90°$.

In some embodiments, a pipe thickness of the bending portion 112 is denoted as $t_1$, and the pipe thickness $t_1$ of the bending portion 112 and the pipe thicknesses t of the two second pipe segments satisfies the following relationship: $0.95t\leq t_1\leq t$.

In some embodiments, adjacent two of the plurality of heat exchange pipes 10, which are in front-to-back contact, abut respectively inside and outside the first pipe segment 11.

In some embodiments, the heat exchanger 100 further includes a fin structure 30, and the fin structure 30 is sandwiched between the second pipe segments 12 of adjacent two of the plurality of heat exchange pipes 10.

It should be noted that the terms "first" and "second" in the specification, claims, and accompanying drawings of this application are used to distinguish between similar objects, and do not need to be used to describe a specific sequence or sequence. It should be understood that data used in this way may be interchangeable in an appropriate case, so that implementation manners of this application described herein can be implemented, for example, in a sequence other than those shown or described herein. In addition, the terms "include" and "have" and any modifications to them are intended to cover non-exclusive inclusion, for example, processes, methods, systems, products or devices that contain a series of steps or units are not necessarily limited to those steps or units that are clearly listed, but may include other steps or units that are not clearly listed or are inherent to these processes, methods, products or devices.

For ease of description, space relative terms can be used here, such as "in . . . above", "at . . . above", "at . . . an upper surface", "above", and the like are used to describe a spatial location relationship between a component or feature shown in the figure and another component or feature. It should be understood that the spatial relative term is intended to include different orientations in use or operation in addition to the orientation described by the component in the figure. For example, if the components in the drawing are inverted, the components described as "above other components or constructions" or "above other components or constructions" will be positioned as "below other components or constructions" or "below other components or constructions". Thus, the exemplary term "in . . . the above" may include "at . . . above" and "at . . . below" the following two directions: The device may also be positioned in different manners (rotated by 90 degrees or in another direction), and the relative description of the space used herein is explained accordingly.

The foregoing descriptions are merely preferred embodiments of this application, and are not intended to limit this application. For a person skilled in the art, various changes and changes may be made in this application. Any modification, equivalent replacement, improvement, etc. made within the spirit and principles of this application shall be included in the protection scope of this application.

What is claimed is:

1. A heat exchanger, comprising:

a plurality of heat exchange pipes arranged in sequence along a preset direction, wherein each of the plurality of heat exchange pipes is a flat pipe and each of the plurality of heat exchange pipes comprises a first pipe segment and a second pipe segment which are connected with each other;

the first pipe segment is provided with a preset bending line, and the preset bending line is perpendicular to the preset direction;

an included angle is defined between a plane where a flat side of the first pipe segment is located and a plane where a corresponding flat side of the second pipe segment is located, and after the first pipe segment being bent along the preset bending line, adjacent two first pipe segments corresponding to adjacent two of the plurality of heat exchange pipes are capable of being in contact with each other;

the heat exchanger is used as a microchannel heat exchanger, the heat exchanger comprises two second pipe segments, and the first pipe segment is located between the two second pipe segments;

two torsional pipe segments are respectively disposed between the first pipe segment and the two second pipe segments to connect the first pipe segment and the two second pipe segments, and each of the two torsional pipe segments comprises two torsional portions and a bending portion, one of the two torsional portions is connected to one of the two second pipe segments, the other of the two torsional portions is connected to the first pipe segment, and each of the two torsional portions is formed by twisting with a preset angle relative to a corresponding second pipe segment; the bending portion is located between the two torsional portions and formed by bending with a preset bending radius;

along the preset direction, the plurality of the heat exchange pipes are inserted in front and back at the first pipe segment, and the bending portion of each of the two torsional pipe segments comprises a front arc part with a radius denoted as R and a rear arc part with a radius denoted as r, wherein, the radius R of the front arc part and the radius r of the rear arc part satisfy the following relationship:

$R>r$, and $5.5t \leq r \leq 25t$, wherein t is pipe thickness of the two second pipe segments of the heat exchange pipe.

2. The heat exchanger of claim 1, wherein before the first pipe segment being bent, the included angle between the plane where the flat side of the first pipe segment is located and the plane where the corresponding flat side of the second pipe segment is located is greater than or equal to 55° and less than 85°.

3. The heat exchanger of claim 1, wherein before the first pipe segment being bent, flat sides of first pipe segments of the plurality of heat exchange pipes are parallel to each other.

4. The heat exchanger of claim 1, wherein each of the plurality of heat exchange pipes further comprises two second pipe segments and the two second pipe segments are respectively connected with two ends of the first pipe segment.

5. The heat exchanger of claim 4, wherein the two second pipe segments are denoted as a third pipe segment and a fourth pipe segment, flat sides of the third pipe segments of the plurality of heat exchange pipes are parallel to each other;

flat sides of the fourth pipe segments of the plurality of heat exchange pipes are parallel to each other;

after the first pipe segment being bent, a plane where an axis of the third pipe segment is located and a plane where an axis of the fourth pipe segment is located are parallel to each other or an included angle is defined between the plane where the axis of the third pipe segment is located and the plane where the axis of the fourth pipe segment is located.

6. The heat exchanger of claim 5, wherein each of the plurality of heat exchange pipes further comprises two torsional pipe segments between the first pipe segment and the third pipe segment and between the first pipe segment and the fourth pipe segment respectively, to correspondingly connect the first pipe segment and the third pipe segment and connect the first pipe segment and the fourth pipe segment.

7. The heat exchanger of claim 6, wherein before the first pipe segment being bent, in each of the plurality of heat exchange pipes, along an extension direction of the first pipe segment, a sum of a total length of the first pipe segment and length of the two torsional pipe segments is denoted as S; and a width of a flat surface of each of the plurality of heat exchange pipes is denoted as W, and the width W of the flat surface of each of the plurality of heat exchange pipes and the sum S of the length of the first pipe segment and the length of the two torsional pipe segments satisfies the following relationship: $3W \leq S \leq 8W$.

8. The heat exchanger of claim 1, wherein a fin structure is disposed on the second pipe segment in each of the plurality of heat exchange pipes.

9. The heat exchanger of claim 1, further comprising a fluid collecting pipe, wherein the fluid collecting pipe extends in the preset direction, and a plurality of second pipe segments are connected and in communication with the fluid collecting pipe.

10. The heat exchanger of claim 1, wherein the plurality of heat exchange pipes are an integrated structure by a molding process.

11. The heat exchanger of claim 1, wherein the radius R of the front arc part and the radius r of the rear arc part satisfy the following relationship: $1<R/r<1.2$.

12. The heat exchanger of claim 1, wherein an included angle between the two second pipe segments of the heat exchange pipe is denoted as θ, a length of each of the two torsional portions is denoted as $L_2$, when the included angle θ satisfies the following relationship: $23° \leq \theta < 70°$, and the length $L_2$ of each of the two torsional portions satisfies the following relationship: $1.05T \leq L_2 \leq 1.25T$, where T is a width of the heat exchange pipe.

13. The heat exchanger of claim 12, wherein a length of the first pipe segment before processing is denoted as L, the length L of the first pipe segment before processing, the included angle θ, the pipe thickness t of the two second pipe segments, and the width T of the heat exchange pipe satisfy the following relationship: $(6t\pi(180-\theta)+2.2T) \leq L \leq (25.5t\pi(180-\theta)+2.5T)$.

14. The heat exchanger of claim 1, wherein an included angle between the two second pipe segments of the heat exchange pipe is denoted as θ, a length of each of the two torsional portions is denoted as $L_2$, when the included angle θ satisfies the following relationship: $0° \leq \theta \leq 5°$, and the length $L_2$ of each of the two torsional portions satisfies the following relationship: $1.5T \leq L_2 \leq 3.5T$, where Tis a width of the heat exchange pipe.

15. The heat exchanger of claim 14, wherein a length of the first pipe segment before processing is denoted as L, the length L of the first pipe segment before processing, the width T of the heat exchange pipe, the pipe thickness t of the two second pipe segments and the included angle θ satisfy the following relationship: $(6t\pi(180-\theta)+3.1T) \leq L \leq (25.5t\pi(180-\theta)+7T)$.

16. The heat exchanger of claim 1, wherein an angle of the two torsional portions twisting relative to the corresponding second pipe segment is denoted as β, the angle β of the two torsional portions twisting relative to the corresponding second pipe segment satisfies the following relationship: $50° \leq \beta \leq 90°$.

17. The heat exchanger of claim 1, wherein a pipe thickness of the bending portion is denoted as $t_1$ and the pipe thickness $t_1$ of the bending portion and the pipe thicknesses t of the two second pipe segments satisfies the following relationship: $0.95t \leq t_1 \leq t$.

18. The heat exchanger of claim 1, wherein adjacent two of the plurality of heat exchange pipes, which are in front-to-back contact, abut respectively inside and outside the first pipe segment.

19. The heat exchanger of claim 1, further comprising a fin structure, wherein the fin structure is sandwiched between the second pipe segments of adjacent two of the plurality of heat exchange pipes.

* * * * *